US005931710A

United States Patent [19]

Johnson, Sr.

[11] Patent Number: 5,931,710

[45] Date of Patent: Aug. 3, 1999

[54] SURFACE DRIVE KIT FOR MARINE CRAFT

[76] Inventor: Clyde Johnson, Sr., P.O. Box 685, Charenton, La. 70523

[21] Appl. No.: 09/005,706

[22] Filed: Jan. 12, 1998

[51] Int. Cl.[6] ..... B63H 5/125

[52] U.S. Cl. ..... 440/55; 440/57; 440/62

[58] Field of Search ..... 440/79, 53, 55, 440/57, 63, 112, 52, 56, 62

[56] References Cited

U.S. PATENT DOCUMENTS

| | | | |
|---|---|---|---|
| 172,367 | 1/1876 | Allyn | 440/53 |
| 1,823,109 | 9/1931 | Louvier | 440/112 |
| 2,415,183 | 2/1947 | Law | 115/35 |
| 3,285,221 | 11/1966 | North | 115/41 |
| 3,933,116 | 1/1976 | Adams et al. . | |
| 4,544,362 | 10/1985 | Arneson . | |
| 4,645,463 | 2/1987 | Arneson . | |
| 4,728,398 | 3/1988 | Weismann | 440/57 |
| 4,775,342 | 10/1988 | Connor et al. . | |
| 4,976,638 | 12/1990 | Grinde . | |
| 5,066,255 | 11/1991 | Sand | 440/112 |
| 5,279,509 | 1/1994 | Gifford . | |
| 5,326,294 | 7/1994 | Schoell . | |

*Primary Examiner*—Sherman Basinger
*Assistant Examiner*—Patrick Muldoon
*Attorney, Agent, or Firm*—Robert N. Montgomery

[57] ABSTRACT

A marine outdrive attachable to the transom of a small fishing boat having an inboard engine. The marine outdrive includes a kit having through transom mounting plate, a fabricated propeller shaft housing pivotally attached to a pivot member which is pivotally attached to said transom plate thereby providing freedom of movement in two planes. The outdrive is supported and maintained under tension in the horizontal plane by a flexible member and a shock absorber thus maintaining automatically contact with any surface in contact with the boat's keel. A kit is provided containing all essential components and instructions for installation of the outdrive on a small fishing craft. All working components are off the shelf stock items or fabricated for easy field repair.

5 Claims, 4 Drawing Sheets

SURFACE DRIVE KIT FOR MARINE CRAFT

BACKGROUND OF THE INVENTION

1. Field of the Invention

This invention relates generally to outdrives for small marine craft, and more particularly to a kit for adapting a surface type drive to small, hallow draft fishing craft for operation in very shallow water.

2. General Background

Small marine craft are generally powered by outboard motors generally comprising a portable, unitary structure including a power head incorporating an internal combustion engine. Such engines have a drive shaft extending vertically from the power head to a lower unit transmission gear for coupling to a horizontal propeller shaft. The unitary unit is suspended from the boat's transom in such a manner that the propeller is totally submerged below the boat's keel.

Somewhat larger marine craft having deeper drafts have the option of inboard propulsion drives which utilize submerged or surface breaking propellers. Their deeper draft allows for mounting the engine's transmission either inboard or outboard. In either case, the transom must be greater than that usually associated with small, shallow draft boats. Most such drives are efficient, high performance systems used for heavy loads and/or high speed.

There is, however, a need for a propulsion unit which will allow small, shallow draft boats to travel at low speed in very shallow water. Since most outdrive systems are expensive and complicated, as is illustrated by U.S. Pat. Nos. 4,976,638, 4,775,342, 5,279,509, 3,933,116, and 5,326,294, and require expert installation, there is a need for an uncomplicated, easily installable inboard-outdrive for small craft such as small flat bottom fishing boats. Through transom direct drives such as that disclosed by U.S. Pat. Nos. 4,976,638, 4,544,362, and 4,645,463 provide a more simplified drive in the form of a pivotal ball joint, these drives are still expensive due to their special pivotal joints and cast housing. Therefore, there is still a need for a simple, inexpensive outdrive which can be installed by the average person on most small fishing boats.

SUMMARY OF THE INVENTION

The present invention puts the inboard outdrive technology within economic reach of the small boat fisherman, thereby allowing the fisherman to gain access to fishing spots otherwise not accessible due to shallow water. By providing an inexpensive, simple kit with easy to follow instructions, the small boat owner can adapt an inboard outdrive kit to his boat in a manner of hours. It is therefore an object of the invention to provide an inboard outdrive kit which includes a template for locating the holes cut and drilled in the boat's transom, all hardware necessary to complete the outdrive assembly, a line-up shaft for connection to a range of engine sizes, a lifting device for lifting the outdrive clear of the water. Engines and couplings are sized and recommended for a number of engine sizes but not furnished as part of the kit. The drive provides connections for attaching a hydraulic steering system which may be purchased in kit form as well.

It is another object of the present invention to provide an inexpensive, marine outdrive apparatus having a thrust angle which is nearly horizontal particularly adapted to provide a surface-piercing propeller, although not necessarily limited to such use.

It is yet another object of the invention to provide an outdrive which is simple and easily maintained with off the shelf parts.

Still another object is to provide an outdrive which may be adapted to most small fishing boats and controlled by a variety of steering or elevating apparatus.

Another object of the invention is to limit the downward angle of the drive to an approximate horizontal plane and maintain a self-adjusting downward force on the outdrive unit, thereby allowing the drive to absorb any shock produced by obstructions under the boat.

Still another object of the invention is to allow the propeller to engage mud and continue to propel the boat in the near absence of water under the boat's keel.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
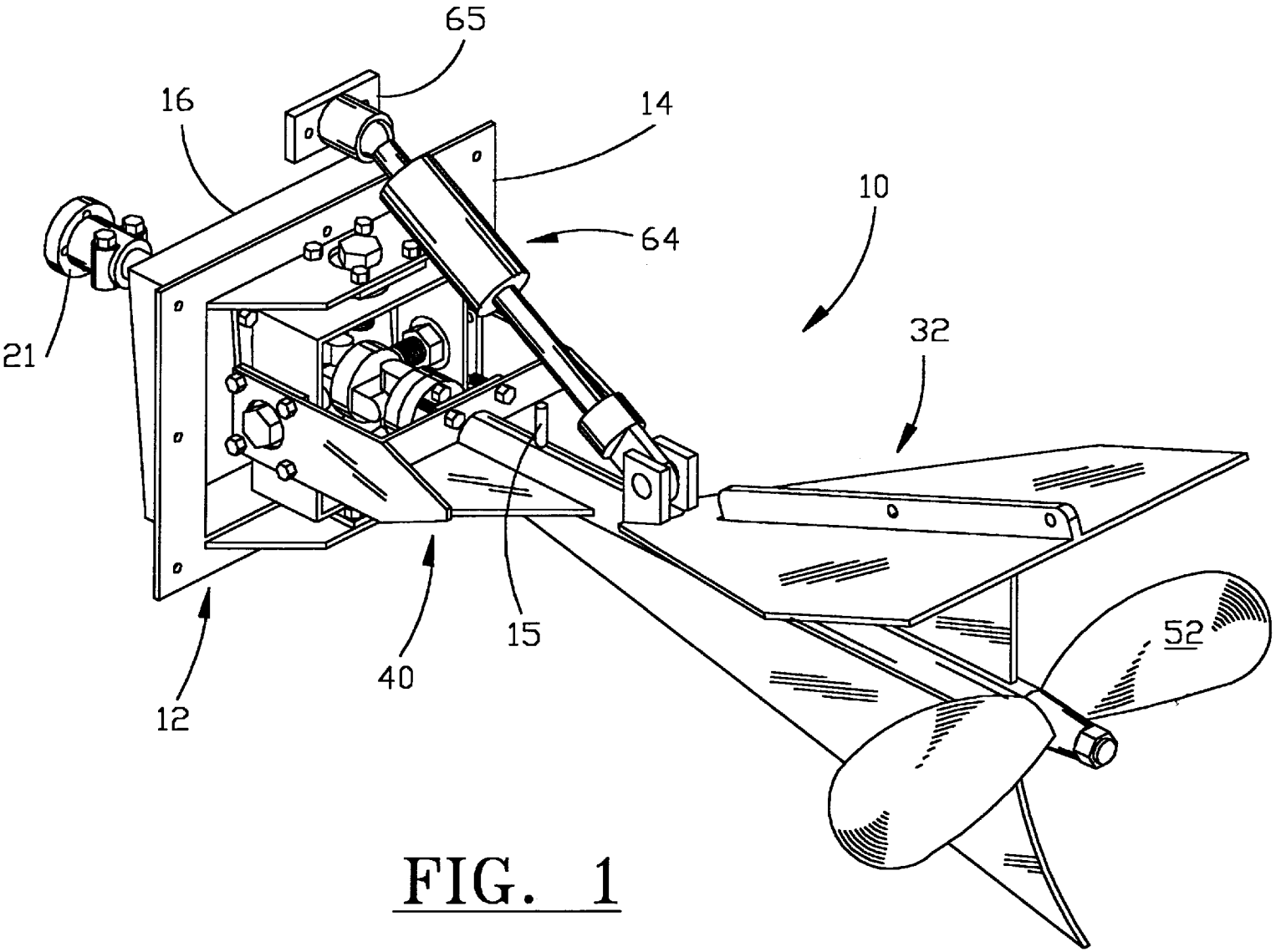
FIG. 1 is an isometric view of the outdrive kit as assembled.
Figures 2, 3:
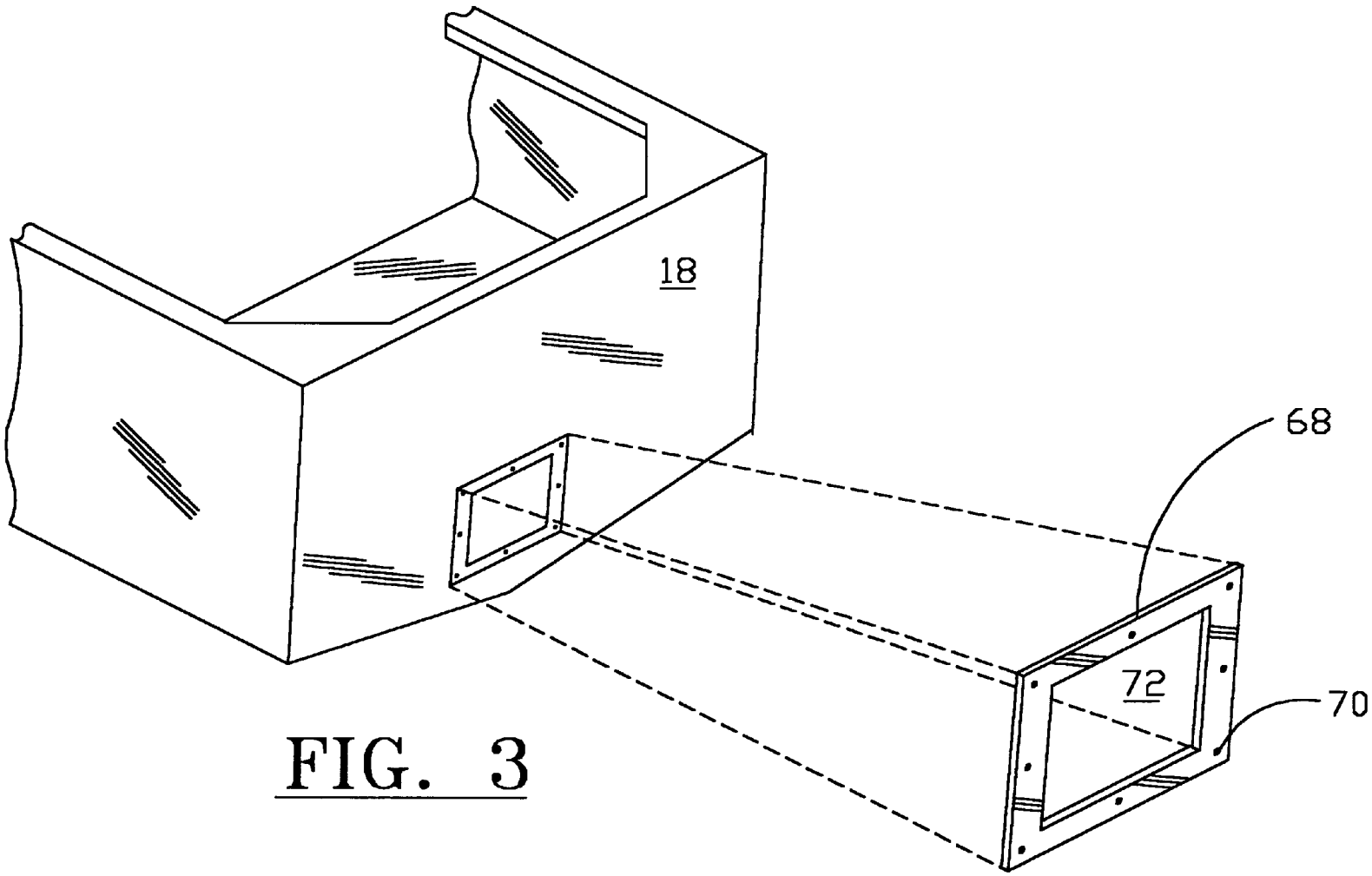
FIG. 2 is an isometric view of the transom template.
FIG. 3 is a partial isometric view of the rear portion of a small boat with template shown in FIG. 2 attached.
Figure 4:
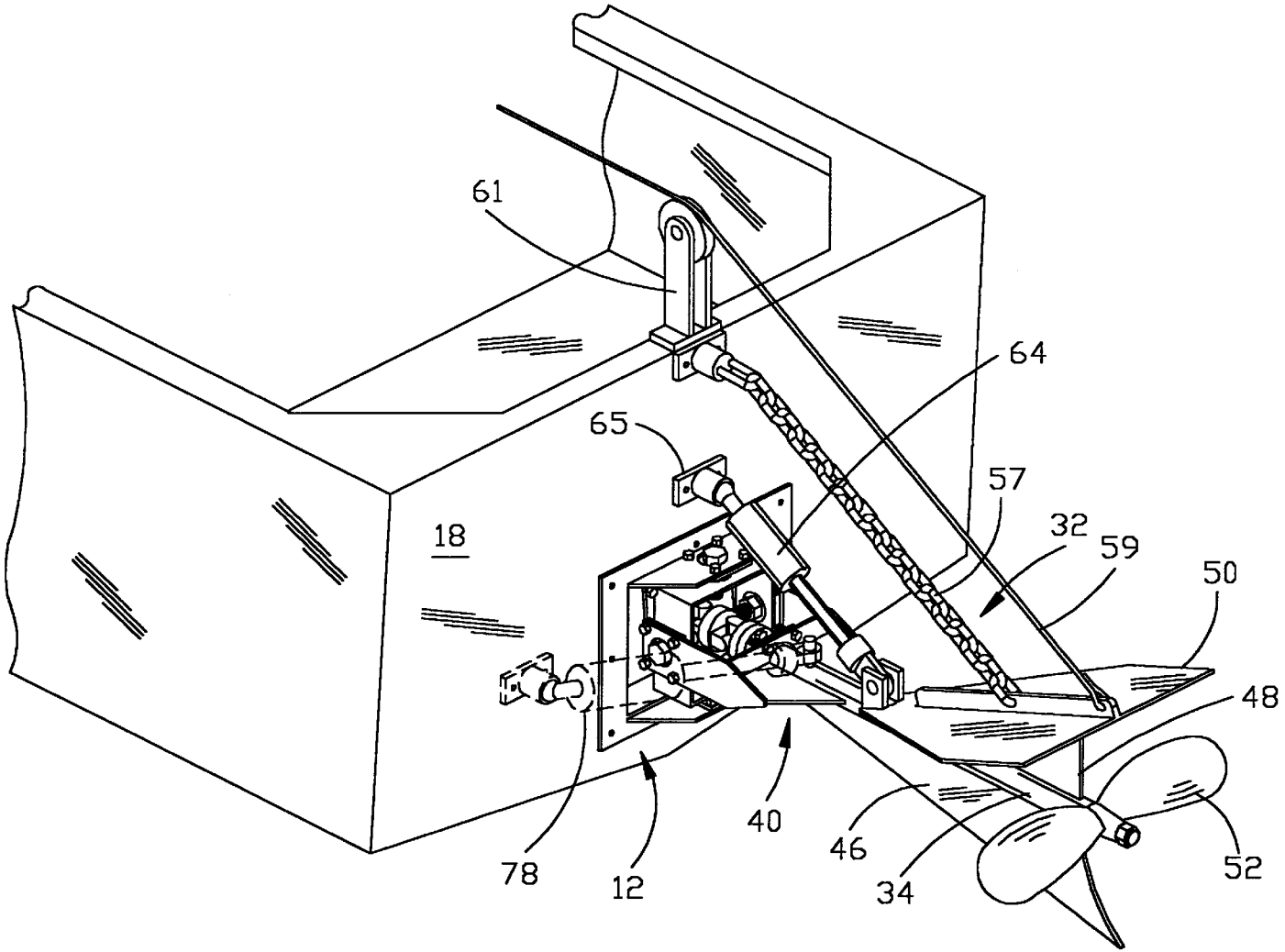
FIG. 4 is a partial isometric view of the assembled outdrive attached to a boat transom.
Figure 5:
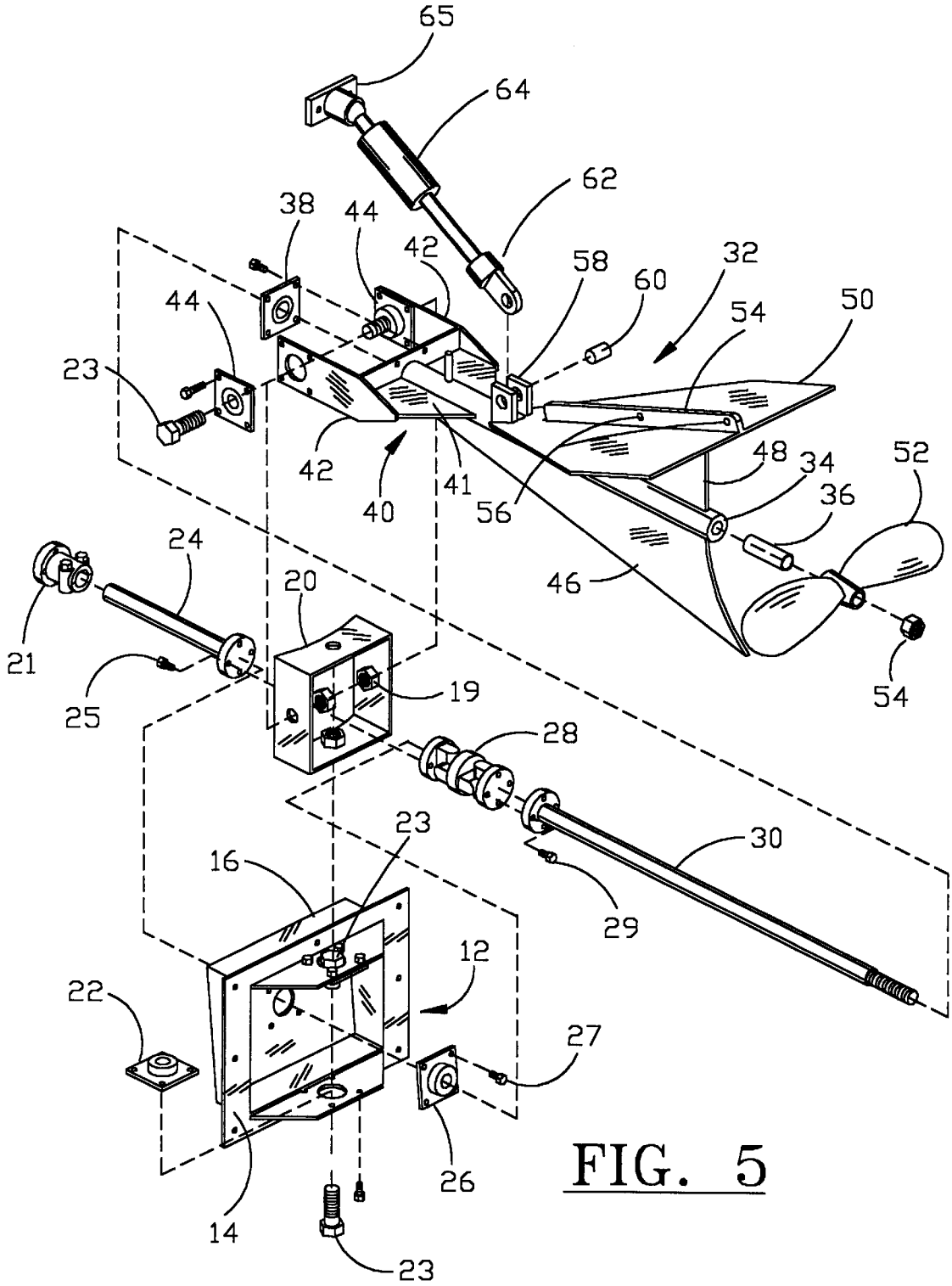
FIG. 5 is an exploded view of the outdrive.

As illustrated in FIG. 1, the outdrive assembly 10 includes a transom attachment 12 consisting of a frame portion 14 which bolts to the face of a boat transom 18 shown in FIG. 3 and a recessed portion 16 which extends through the transom 18; a pivot member 20, best seen in FIG. 5, is pivotally about its vertical axis, and is attached via upper and lower flange bearings 22, screws 23 and nuts 19 to the transom attachment 12; a stub shaft 24 inserted through a flange bearing 26, attached to the transom attachment 12 via screws 27, the stub shaft 24 extending through the recessed portion of the transom attachment 12, and connected at one end to a universal joint 28 via screws 25 which in turn is connected to the propeller shaft 30 via screws 29 the stub shaft 24 is also connected to a coupling 21 at its opposite end; and a shaft housing assembly 32 including a tube portion 34 having an internal bushing 36 and a flange bearing 38 for supporting the propeller shaft 30. The shaft housing assembly further comprises a horizontal clevis portion 40 having ears 42 and webs 41 attached horizontally to one end of the tube portion 34 in a manner whereby the shaft housing 32 is mountable in a horizontal plane to the pivot member 20 via flange bearing 44, screws 23 and nuts 19; a lower stabilizing fin 46 attached vertically to the tube portion 34; a dorsal fin 46 attached vertically to the tube portion 34 at approximately a 30 degree angle; a horizontal anti-cavitation plate 50 attached to the dorsal fin 48; and a propeller 52 attached to propeller shaft 30 and threadably secured with a nut 54. The propeller 52 is a weedless two blade type propeller. This allows the lead or pitch of the propeller 52 to serve as a screw when engaging mud, thereby propelling the boat even when there is little or no water present under the keel of the boat. The lower fin 46 slices into the mud, thereby allowing the propeller to engage the mud. The and-cavitation plate 50 further includes a rib or cleat member 54 having a hole 56 for attaching a safety chain 57 for supporting the outdrive 10 in a horizontal position and a second hole 56 for attachment of a cable 59 used to lift the drive units clear of the water via a pullychain bracket 61 and its accompanying winch assembly, not shown but included as part of the kit. Bracket ears 58 are also provided attached to the tube portion 34 for connection via a pin 60 to the rod end of a shock absorber 64, the butt end connection 65 being a swivel joint, mountable to the boat transom 18 as seen in FIG. 4. The shock absorber 64 is in tension, thereby keeping the chain 57 taut when the drive 10 is horizontal. Therefore, if an obstruction is encountered by the lower fin 46, the drive 10 displaces the shock absorber 64 then returns to its operating position without bouncing or allowing the drive to exceed a preset angle. A template 68 is provided as seen in FIG. 2 and shown in place in FIG. 3 on a small fishing boat for marking the mounting holes 70 and cutout 72 for receiving the recessed portion 16 of transom attachment 12. FIG. 4 illustrates how the assembled unit 10 is installed on a small fishing boat.

By having the pivot member 20 pivotal about its vertical axis when mounted to the transom attachment 12 via bearing 22 and the horizontal clevis portion 40 of the housing assembly 32 attached to the pivotal member 20 at 90 degree angles, the housing assembly 32 has freedom of movement in both horizontal and vertical planes. The universal joint 28 is positioned so that its center lines correspond with that of the pivot member 20 bearing 22 axis. All bearings 22, 26, 38, 44, the universal joint 28, the propeller 52, shaft coupling 21, as well as the shock absorber 64, are commercial items readily available off the shelf in most hardware, automotive or marine supply stores. However, the universal joint 28 may be modified by grinding a portion of the joint in a manner whereby a greater degree of angulation is achieved. The shaft housing assembly 32 is a fabricated assembly rather than a single cast component to allow for easy field repair. A variety of engines may be used, depending on the capacity of the craft.

It should also be noted that a pivot pin 15, seen in FIG. 1, is attached to the upper side of the tube portion 34 to provide a connecting point for a steering actuator 78 as illustrated in FIG. 4 provided as an optional accessory to the outdrive kit.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. An outdrive kit for attachment to a small fishing craft comprising:

a) a transom attachment having vertical pivot mounts;

b) a pivot member pivotally attachable to said transom attachment, having horizontal and vertical pivot mounts;

c) a first propeller shaft member rotatably mountable to said transom attachment;

d) a propeller shaft housing having a second propeller shaft rotatable therein and a pivotal clevis attachment mountable to said pivot member horizontal mounts;

e) a plurality of bearings for mounting said pivot member, said propeller shaft housing and said first propeller shaft member;

f) a universal joint attachable to said first propeller shaft and said second propeller shaft;

g) a propeller attachable to said second propeller shaft;

h) a chain for supporting said propeller shaft housing in a horizontal plane;

i) a cable and winch for lifting said propeller housing relative to said small fishing craft;

j) a shock absorber attachable to said propeller shaft housing;

k) a packet of assorted fasteners for connecting elements a–j;

l) a template for locating mounting holes for said transom attachment; and m) instructions and illustrations detailing how to mount said kit to a small fishing craft.

2. An outdrive kit for attachment to a small fishing craft according to claim 1, further including a steering kit comprising a means for positioning said propeller shaft housing horizontally relative to said craft.

3. A method for attaching an outdrive to a small fishing craft comprising the steps of;

a) providing an outdrive kit comprising:

i) a transom attachment having vertical pivot mounts;

ii) a pivot member pivotally attachable to said transom attachment, having horizontal and vertical pivot mounts;

iii) a first propeller shaft member rotatable mountable to said transom attachment;

iv) a propeller shaft housing having a second propeller shaft rotatable therein and a pivotal clevis attachment mountable to said pivot member horizontal mounts;

v) a plurality of bearings for mounting said pivot member, said propeller shaft housing and said first propeller shaft member;

vi) a universal joint attachable to said first propeller shaft and said second propeller shaft;

vii) a propeller attachable to said second propeller shaft;

viii) a chain for supporting said propeller shaft housing in a horizontal plane;

ix) a cable and winch for lifting said propeller housing relative to said small fishing craft;

x) a shock absorber attachable to said propeller shaft housing;

xi) a packet of assorted fasteners for connecting elements a–j;

xii) a template for locating mounting holes for said transom attachment; and xiii) instructions and illustrations detailing how to mount said kit to a small fishing craft;

b) locating and cutting mounting holes in the transom of a small fishing craft per said template;

c) assembling said outdrive per said instructions and illustrations;

d) mounting said outdrive to said transom;

e) securing said chain to said propeller housing and said transom in a manner whereby said outdrive is held in a horizontal plane;

f) attaching said shock absorber to said transom in a manner whereby a tension is exerted on said propeller housing;

g) attaching said cable and winch assembly to said transom and attaching its cable to said propeller housing;

h) attaching a coupling to a portion of said first propeller shaft;

i) attaching said coupling to an engine; and j) providing a means for pivoting said propeller housing in a horizontal plane.

4. The method according to claim 3 further comprising the step of grinding away a portion of said universal joint to allow for a greater degree of angulation.

5. A method of maintaining propulsion of a small marine craft in the near absence of water comprising an outdrive kit having a pivotal propeller shaft and housing including a propeller said kit mounted on the transom of a small craft, the shaft held in essentially a horizontal plane by a flexible lifting means and in downward tension by a shock absorber with sufficient force to insure propeller contact with a mud surface, said propeller shaft having a trust angle which is nearly horizontal and positioned to insure near perpendicular propeller contact with the mud bottom when in near contact with the bottom of the craft in a manner whereby said propeller engages said mud surface in a screw like manner thereby providing continuous propulsion through said mud.

* * * * *